US010391621B2

(12) United States Patent
Wiedner et al.

(10) Patent No.: US 10,391,621 B2
(45) Date of Patent: Aug. 27, 2019

(54) HANDHELD POWER TOOL

(71) Applicant: Hilti Aktiengesellschaft, Schaan (LI)

(72) Inventors: Aaron Wiedner, Landsberg (DE); Thomas Hofbrucker, Mammendorf (DE); Eduard Pfeiffer, Halblech (DE); Markus Hartmann, Mauerstetten (DE)

(73) Assignee: Hilti Aktiengesellschaft, Schaan (LI)

( * ) Notice: Subject to any disclaimer, the term of this patent is extended or adjusted under 35 U.S.C. 154(b) by 458 days.

(21) Appl. No.: 15/105,199

(22) PCT Filed: Dec. 9, 2014

(86) PCT No.: PCT/EP2014/077058
§ 371 (c)(1),
(2) Date: Jun. 16, 2016

(87) PCT Pub. No.: WO2015/091112
PCT Pub. Date: Jun. 25, 2015

(65) Prior Publication Data

US 2016/0311103 A1 Oct. 27, 2016

(30) Foreign Application Priority Data

Dec. 18, 2013 (EP) ..... 13197954

(51) Int. Cl.
*B25D 17/06* (2006.01)
*B25D 17/24* (2006.01)
*B25D 16/00* (2006.01)

(52) U.S. Cl.
CPC ..... *B25D 17/06* (2013.01); *B25D 16/00* (2013.01); *B25D 17/24* (2013.01); *B25D 17/245* (2013.01);
(Continued)

(58) Field of Classification Search
CPC ..... B25D 17/20
See application file for complete search history.

(56) References Cited

U.S. PATENT DOCUMENTS 3,456,740 A 7/1969 Paule et al.
4,476,941 A * 10/1984 Buck ..... B25D 17/06 173/117
(Continued)

FOREIGN PATENT DOCUMENTS

CN 1169903 A 1/1998
CN 1171321 A 1/1998
(Continued)

*Primary Examiner* — Andrew M Tecco
*Assistant Examiner* — Praachi M Pathak
(74) *Attorney, Agent, or Firm* — Davidson, Davidson & Kappel, LLC

(57) ABSTRACT

The handheld power tool has a tool receptacle for accommodating a tool on a working axis (11) and an electric motor (5). A pneumatic percussion mechanism (6) has an exciter, which is moved back-and-forth by the motor (5) periodically in parallel to the working axis (11), a striker (14), which is movable on the working axis (11) and is coupled via a pneumatic spring (18) to the exciter, and an anvil (19), which is situated movably on the working axis (11) and is situated downstream from the striker (14) in the percussion direction (12). The anvil (19) has a cylindrical anvil section (22) having a diameter and multiple channels (30) extending over the entire length (31) of the anvil section (22). A cross-sectional area of the anvil section (22) is at most 5% less than a circular area defined by the diameter.

12 Claims, 1 Drawing Sheet

(52) U.S. Cl.
CPC ..... *B25D 2217/0015* (2013.01); *B25D 2217/0019* (2013.01); *B25D 2250/225* (2013.01)

(56) References Cited

U.S. PATENT DOCUMENTS

| | | | | |
|---|---|---|---|---|
| 4,567,951 | A | 2/1986 | Fehrle et al. | |
| 4,582,144 | A | 4/1986 | Mizutani | |
| 4,630,687 | A * | 12/1986 | Dummermuth | B25D 9/06 173/128 |
| 6,467,555 | B2 | 10/2002 | Plank et al. | |
| 7,168,504 | B2 | 1/2007 | Hetcher et al. | |
| 9,044,847 | B2 * | 6/2015 | Kohlschmied | B25D 11/005 |
| 2002/0108766 | A1 * | 8/2002 | Plank | B25D 11/005 173/171 |
| 2005/0224243 | A1 * | 10/2005 | Baumann | B25D 17/088 173/128 |
| 2008/0245220 | A1 | 10/2008 | Duesselberg et al. | |
| 2010/0300718 | A1 | 12/2010 | Hartmann et al. | |
| 2011/0303430 | A1 | 12/2011 | Hartmann et al. | |
| 2012/0125649 | A1 * | 5/2012 | Ohlendorf | B25D 17/24 173/162.2 |

FOREIGN PATENT DOCUMENTS

| | | | |
|---|---|---|---|
| CN | 1367067 | A | 9/2002 |
| CN | 1551816 | A | 12/2004 |
| CN | 1572432 | A | 2/2005 |
| CN | 101228008 | A | 7/2008 |
| CN | 102039584 | A | 5/2011 |
| DE | 679558 | | 8/1939 |
| DE | 10323606 | A1 | 12/2004 |
| FR | 2531138 | | 2/1984 |
| GB | 2313084 | | 1/1998 |
| GB | 2314795 | | 1/1998 |

* cited by examiner

HANDHELD POWER TOOL

BACKGROUND

The present invention relates to a handheld power tool, as is known from DE 10323606 A1.

SUMMARY OF THE INVENTION

The handheld power tool according to the present invention has a tool receptacle for accommodating a tool on a working axis and an electric motor. A pneumatic percussion mechanism has an exciter, which is moved back-and-forth periodically in parallel to the working axis by the motor, a striker which is movable on the working axis, and is coupled via a pneumatic spring to the exciter, and an anvil, which is situated movably on the working axis, and is situated downstream from the striker in the percussion direction. The anvil has a cylindrical anvil section having a diameter and multiple channels extending over the entire length of the anvil section in the anvil section. A cross-sectional area of the anvil section is at most 5% less than the circular area defined by the diameter. The cross-sectional area of the anvil section is preferably at least 1.0% less than the circular area. The channels enable a small and defined air exchange, which decelerates the anvil in a non-percussive position.

A guide sleeve has a cylindrical guide section, in which the cylindrical anvil section is guided. An internal diameter of the guide section is equal to the diameter of the anvil section. The cylindrical inner surface of the guide section is smooth and unstructured.

BRIEF DESCRIPTION OF THE DRAWINGS

The following description explains the invention on the basis of exemplary embodiments and figures.

DETAILED DESCRIPTION

Figure 1:
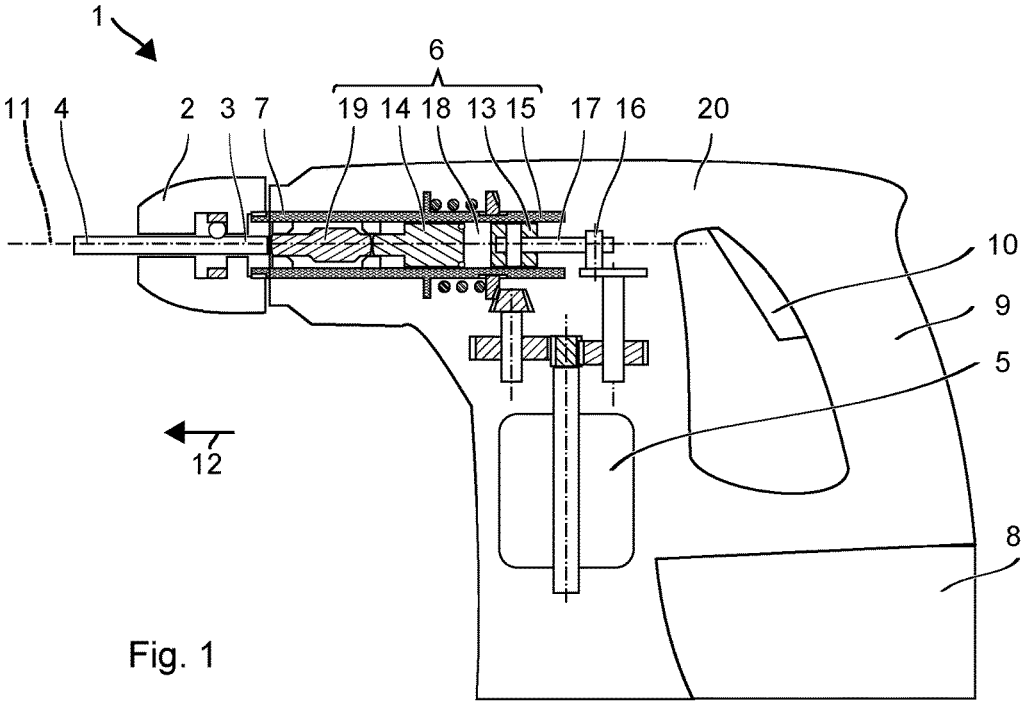
FIG. 1 shows a percussion drill
Figure 2:
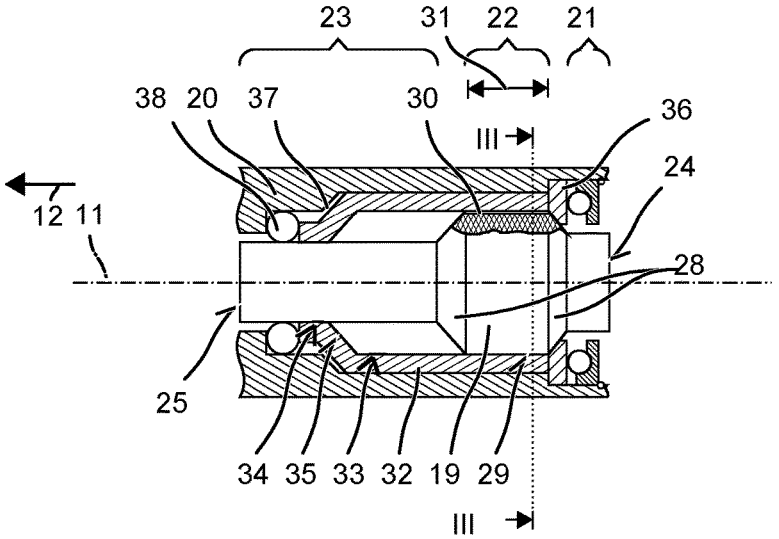
FIG. 2 shows an anvil in a guide sleeve

Identical or functionally identical elements are indicated by identical reference numerals in the figures, if not specified otherwise.

FIG. 1 schematically shows a percussion drill 1 as an example of a chiseling handheld power tool. Percussion drill 1 has a tool receptacle 2, into which a shaft end 3 of a tool, for example, a drill 4, may be inserted. A primary drive of percussion drill 1 is formed by a motor 5, which drives a percussion mechanism 6 and an output shaft 7. A battery pack 8 or a power cord supplies motor 5 with current. A user may guide percussion drill 1 with the aid of a handle 9 and put percussion drill 1 into operation with the aid of a system switch 10. During operation, percussion drill 1 continuously rotates drill 4 about a working axis 11 and may pound drill 4 in percussion direction 12 along working axis 11 into a hard surface.

Percussion mechanism 6 is a pneumatic percussion mechanism 6. An exciter piston 13 and a striker 14 are movably guided in a guide tube 15 in percussion mechanism 6 along working axis 11. Exciter piston 13 is coupled via an eccentric 16 to motor 5 and is forced into a periodic, linear movement. A connecting rod 17 connects eccentric 16 to exciter piston 13. A pneumatic spring, which is formed by a pneumatic chamber 18 between exciter piston 13 and striker 14, couples a movement of striker 14 to the movement of exciter piston 13. Pallet 14 strikes on an anvil 19, which relays the impact to drill 4. Percussion mechanism 6 and preferably the further drive components are situated inside a machine housing 20.

Anvil 19 has three successive sections 21, 22, 23 in percussion direction 12. The three (anvil) sections 21, 22, 23 are essentially cylindrical. Front, first section 21 forms an impact-absorbing percussion surface 24, on which striker 14 strikes. Rear, third section 23 forms impact-emitting percussion surface 25, which transmits the impact to drill 4. Rear section 23 is the longest of the three sections and is used for axially guiding anvil 19. Second and middle section 22 is also used for axially guiding anvil 19. Anvil 19 is movable along working axis 11 and is inhibited in the radial direction by the two sections 22, 23. Diameter 26 of middle section 22 is greater than diameters 27 of front and rear sections 21, 23. Two conical sections 28, which merge into front or rear section 21, 23, respectively, adjoin middle section 22 on both sides.

Figure 3:
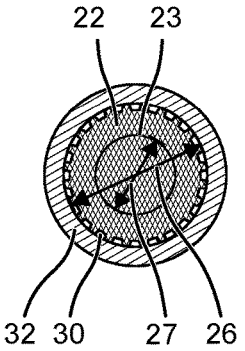
FIG. 3 shows a cross-section in plain III-III

Middle section 22 has a knurled lateral surface 29. The knurling creates a plurality of, for example, more than 20 identical channels 30. Channels 30 are parallel to working axis 11, for example. FIG. 3 shows a depth and width of channels 30 in exaggerated form. The depth is preferably in the range of 0.25% to 2.5% of diameter 26 of section 22. The width of channels 30 may be approximately equal to the depth of channels 30. The number of channels 30 and the dimensions thereof reduce the cross-sectional area of middle section 22 in relation to the corresponding non-knurled solid cylinder. The cross-sectional area is at most 5% and preferably at least 1.0% less than a circular area, the diameter of which is equal to the diameter of middle section 22. Each of channels 30 extends over the entire length 31 of middle section 22, i.e., channels 30 begin and end at conical sections 28.

Anvil 19 is guided strictly coaxially in relation to working axis 11 by a guide sleeve 32. Guide sleeve 32 is manufactured having a radial play of 10 μm, as is typical, so that anvil 19 can slide in guide sleeve 32. Guide sleeve 32 presses in the radial direction against middle anvil section 22 and third section 23. Guide sleeve 32 has a first guide section 33 and, following in percussion direction 12, a second guide section 34. First guide section 33 guides middle anvil section 22, accordingly, the internal diameter of first guide section 33 is equal to diameter 26 of middle anvil section 22. Second guide section 34 guides third anvil section 23 and has an internal diameter equal to smaller diameter 27 of third anvil section 23. First anvil section 21 is unguided. The inner surfaces of guide sleeve 32, in particular of the two guide sections 33, 34, are smooth, without introduced structures such as grooves, channels, holes, etc. A funnel-shaped surface 35 connects first guide section 33 to second guide section 34. Funnel-shaped surface 35 is used as a stop for anvil 19 in percussion direction 12. Funnel-shaped surface 35 is preferably formed as complementary to conical section 28 of anvil 19, which faces in percussion direction 12. Anvil 19 has a further stop 36, against which anvil 19 presses in its base position against percussion direction 12.

Anvil 19 and guide 32 close off an air chamber 35. Channels 30 in anvil 19 form the single duct, via which air may enter air chamber 35 and exit from air chamber 35. In the case of an exemplary knurled duct, which corresponds to 1.5% of the cross section of middle guide section 33, the air is strongly compressed by anvil 19 when it flies in percussion direction 12 as a result of an impact. A displacement rate of the air displaced by rapidly flying anvil 19 is higher than the exit rate of the air from air chamber 35 through channels 30, which form the duct. The increased pressure in the air chamber decelerates anvil 19. As soon as anvil 19 has significantly lost speed, the exit rate exceeds the displacement rate. The pressure drops. Anvil 19 is decelerated in percussion direction 12, but not moved by the air against percussion direction 12.

Guide sleeve 32 may be suspended in machine housing 20 so it is movable in percussion direction 12. A gap 37 separates an end face of guide sleeve 32, which faces in percussion direction 12, from machine housing 20. A damping element 38, for example, a ring made of rubber, pretensions guide sleeve 32 against percussion direction 12. In the event of an impact of anvil 19 on funnel-shaped surface 35, guide sleeve 32 is deflected against damping element 38 in the percussion direction.

The invention claimed is:

1. A handheld power tool comprising:

a tool receptacle for accommodating a tool on a working axis;

an electric motor;

a pneumatic percussion mechanism having an exciter moved back-and-forth by the motor periodically in parallel to the working axis;

a striker movable on the working axis and coupled via a pneumatic spring to the exciter; and an anvil situated movably on the working axis and downstream from the striker in the percussion direction;

the anvil having a cylindrical anvil section having a diameter and multiple longitudinal channels extending over an entire length and distributed around a circumference of the cylindrical anvil section, a cross-sectional area of the anvil section being at most 5% less than a circular area defined by the diameter.

2. The handheld power tool as recited in claim 1 wherein the cross-sectional area of the anvil section is at least 1.0% less than the circular area.

3. The handheld power tool as recited in claim 1 wherein a guide sleeve has a cylindrical guide section, the cylindrical anvil section being guided in the cylindrical guide section, an internal diameter of the guide section being equal to the diameter of the anvil section.

4. The handheld power tool as recited in claim 3 wherein the anvil has a further cylindrical anvil section situated in the percussion direction downstream from the anvil section, the guide sleeve having a further guide section, the further anvil section being guided in an airtight manner in the further guide section.

5. The handheld power tool as recited in claim 3 wherein the anvil and the guide sleeve close off an air chamber only ventilated through the channels.

6. The handheld power tool as recited in claim 3 wherein the guide sleeve is movable along the working axis and is pre-tensioned by a damper against the percussion direction.

7. The handheld power tool as recited in claim 1 wherein the cross-sectional area of the anvil section is constant over the entire length of the anvil section.

8. The handheld power tool as recited in claim 1 wherein the exciter is coupled via an eccentric to the motor.

9. The handheld power tool as recited in claim 8 wherein the exciter is coupled to the eccentric by a connecting rod.

10. The handheld power tool as recited in claim 1 wherein the cylindrical anvil section has a knurled lateral surface.

11. The handheld power tool as recited in claim 1 wherein a number of the multiple longitudinal channels exceeds 20.

12. The handheld power tool as recited in claim 1 wherein a depth of the multiple longitudinal channels is in a range of 0.25% to 2.5% of the diameter.

* * * * *